United States Patent [19]

Cox

[11] Patent Number: 4,473,168

[45] Date of Patent: Sep. 25, 1984

[54] OVERCAP HAVING A RESILIENTLY DEFORMABLE MEMBER FOR RESEALING DISPENSING APERTURE IN INTEGRAL CONTAINER LID

[75] Inventor: William A. Cox, Cincinnati, Ohio

[73] Assignee: The Procter & Gamble Company, Cincinnati, Ohio

[21] Appl. No.: 536,598

[22] Filed: Sep. 28, 1983

[51] Int. Cl.[3] ..... B65D 51/22; B65D 43/16

[52] U.S. Cl. ..... 220/258; 220/259; 220/335; 220/359

[58] Field of Search ..... 220/256, 257, 258, 259, 220/260, 270, 269, 359, 339, 335; 229/7 R

[56] References Cited

U.S. PATENT DOCUMENTS

| | | | |
|---|---|---|---|
| 1,761,597 | 6/1930 | Taylor . | |
| 2,031,845 | 2/1936 | Morgan . | |
| 2,374,384 | 4/1945 | Sansom . | |
| 2,483,586 | 10/1949 | Limpert . | |
| 2,740,547 | 4/1956 | Huntting . | |
| 2,870,935 | 1/1959 | Houghtelling . | |
| 3,029,973 | 4/1962 | Burchett . | |
| 3,067,899 | 12/1962 | Everett . | |
| 3,259,265 | 7/1966 | Stuart . | |
| 3,312,368 | 4/1967 | Reynolds et al. . | |
| 3,338,462 | 8/1967 | Reynolds et al. . | |
| 3,339,788 | 9/1967 | Lipske . | |
| 3,389,827 | 6/1968 | Abere et al. . | |
| 3,401,819 | 9/1968 | Salamone . | |
| 3,419,181 | 12/1968 | Stec . | |
| 3,726,432 | 4/1973 | Gentile . | |
| 3,933,297 | 1/1976 | Carlsson | 229/3.1 |
| 3,946,872 | 3/1976 | Sturm | 206/498 |
| 3,951,331 | 4/1976 | Smith et al. . | |
| 3,952,911 | 4/1976 | Bozek et al. | 220/269 |
| 3,952,914 | 4/1976 | Vogt | 220/339 |
| 3,990,603 | 11/1976 | Brochman | 220/260 |
| 4,008,823 | 2/1977 | Tarro | 220/269 |
| 4,029,033 | 6/1977 | Kerwin et al. | 113/121 |
| 4,030,630 | 6/1977 | Yealy | 220/258 |
| 4,034,132 | 7/1977 | Manuel | 428/36 |
| 4,059,201 | 11/1977 | Foster | 220/258 |
| 4,078,695 | 3/1978 | Potts | 220/269 |
| 4,083,471 | 4/1978 | Frank | 220/269 |
| 4,164,303 | 8/1979 | Waterbury | 220/359 |
| 4,189,060 | 2/1980 | Trotman | 220/260 |
| 4,232,797 | 11/1980 | Waterbury | 220/359 |
| 4,234,099 | 11/1980 | Tarro | 220/269 |
| 4,258,876 | 3/1981 | Ljungcrantz | 220/258 |
| 4,267,937 | 5/1981 | Piltz et al. | 220/270 |
| 4,301,939 | 11/1981 | Pupp | 220/267 |
| 4,339,053 | 7/1982 | Tarro | 220/258 |
| 4,377,247 | 3/1983 | Hazard et al. | 222/517 |

*Primary Examiner*—George T. Hall

*Attorney, Agent, or Firm*—John J. Ryberg; E. Kelly Linman; John V. Gorman

[57] ABSTRACT

An overcap assembly for a liquid container that prevents dirt from contaminating the container's integral top lid and sufficiently reseals the container's product-dispensing orifice after initial opening by means of a resiliently deformable sealing member which allows subsequent shaking of the container to redistribute suspended solids such as orange juice pulp. The overcap assembly may be hingedly fixed to or fully removable from the container.

26 Claims, 11 Drawing Figures

OVERCAP HAVING A RESILIENTLY DEFORMABLE MEMBER FOR RESEALING DISPENSING APERTURE IN INTEGRAL CONTAINER LID

TECHNICAL FIELD

This invention pertains to container overcaps, and more particularly to a liquid container overcap that simultaneously prevents dirt from accumulating on the container's top lid and reseals the container after one or more discrete content-dispensing apertures have been made or opened in the container's integral top lid.

BACKGROUND OF THE INVENTION

Easy open containers are in wide use today, particularly in the soft drink and fruit juice industry. The top lids of these containers are usually opened by either punching a hole, removing a pre-scored pull tab, or by removing a tape tab that covers one or more pre-formed dispensing apertures. While these easy open containers have proved to be a tremendous commercial success, they are the source of three major consumer complaints. First, dirt and other foreign matter tend to accumulate on the container's top lid during shipping and storage. When a consumer drinks the product directly from the container, the person's lips come into direct contact with the contaminated top surface. Second, if the product is not entirely consumed, foreign matter can easily enter the opened container during storage. Finally, once opened, the container cannot be resealed and subsequently shaken to redistribute suspended solids such as orange juice pulp.

It is well known in the art to provide a container with an overcap to prevent dust and dirt from contaminating the container's top lid and, ultimately, the product itself, as for example shown by the embodiments in U.S. Pat. No. 3,419,181. However, once the container has been opened, these overcaps cannot be used to reseal the container's dispensing orifice to allow subsequent shaking of the container. Accordingly, it is a principal object of the present invention to provide a container with an overcap assembly that prevents dust and dirt from accumulating on the container's top lid and that also sufficiently reseals the container after initial opening to allow the unused product to be shaken.

It is another object of the present invention to provide a container with a protective, resealing overcap that may be hinged to or fully removable from the container's top lid.

It is yet another object of the present invention to enhance a container's aesthetic appearance by covering the container's top lid with a protective, resealing overcap having a top surface suitable for printed graphics and labeling.

SUMMARY OF THE INVENTION

In a preferred embodiment of the present invention, an overcap assembly is hingedly fixed to the integral top lid of a liquid container having an upwardly projecting outer rim. The container's top lid includes one or more dispensing apertures made by either punching a hole or removing a pre-scored pull tab. Alternatively, the top lid may have a pre-cut dispensing aperture initially sealed with a removable tape tab. A sealing member, preferably made of a soft, resiliently deformable, sponge-like material, is attached to the overcap's inner surface directly above the container's dispensing aperture. The overcap's outer edge is in the form of a U-shaped flange that is complementary to the container's upwardly projecting outer rim. When the overcap assembly is re-applied to the container, the U-shape flange and the upwardly projecting outer rim tightly engage and force the sealing member against the dispensing aperture thus forming a seal. This seal between the dispensing aperture and the sealing member may be enhanced by applying finger pressure to the area of the overcap directly above the dispensing aperture.

DETAILED DESCRIPTION OF THE INVENTION

Figure 1:
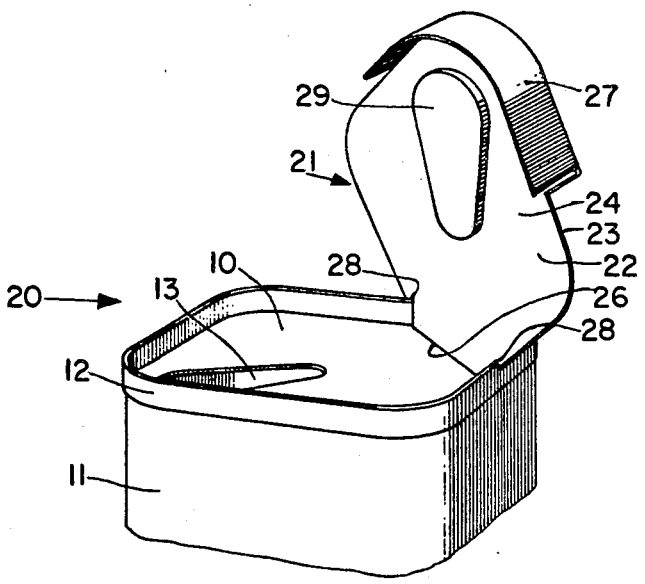
FIG. 1 is a perspective view of a preferred embodiment of the present invention, said embodiment being hingedly attached to the top of a container having a upwardly projecting outer rim.
Figure 2:
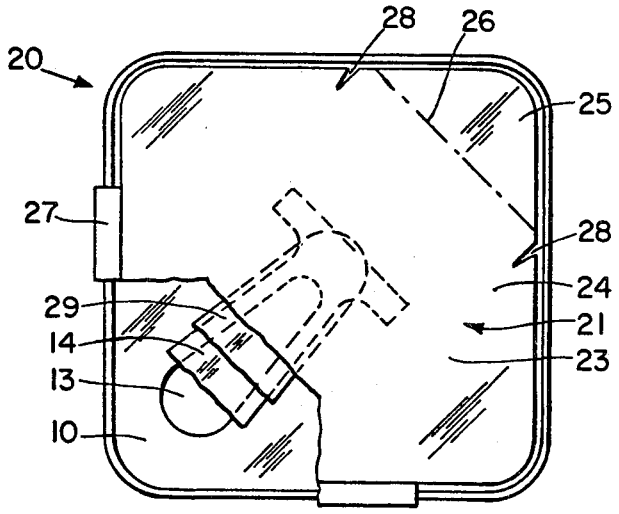
FIG. 2 is a partially segmented plan view of the overcap assembly illustrated in FIG. 1.

It should be noted that although the following detailed description of the embodiment shown in FIGS. 1 and 2 is specifically directed to an overcap assembly that is hingedly fixed to the top lid of a container, the present invention may be practiced with equal facility in applications where the overcap assembly is completely removable from the container, as generally shown in the embodiments of FIGS. 3, 5, 7 and 10.

The liquid container illustrated in FIGS. 1 and 2 is comprised of an integral top lid 10 rigidly fixed to the container's side wall 11 (using any common technique well known in the art) which creates an upwardly projecting outer rim 12. An illustrative example of this type of container is found in U.S. Pat. No. 3,406,891. The integral top lid 10 has a dispensing aperture 13 pre-cut in the area adjacent to the rim 12 and is initially sealed with a fully-removable adhesive tape tap 14 of a type also known in the art (shown fully removed in FIG. 1), as generally exemplified by U.S. Pat. N0. 2,870,935.

The overcap assembly generally denoted as 20 is preferably made of material exhibiting some degree of flexibility such as plastic, waxed cardboard, polyethylene-coated boardstock, or thin metal. In the embodiment shown in FIGS. 1 and 2, overcap assembly 20 comprises a closure member 21 having an inner surface 22, an outer surface 23, a hingedly movable portion 24, a fixed portion 25 (as shown in FIG. 2), a score line 26 between the hingedly moveable portion 24 and the fixed portion 25, and a U-shaped raised outer flange 27. The U-shaped raised outer flange 27 releasably engages the corresponding upwardly projecting rim 12 of the container via an interference fit when the overcap assembly 20 is in its closed position (as shown in FIG. 2). The closure member 21 preferably has two small notches 28 cut in its sides near the score line 26 that releasably engage the container's upwardly projecting rim 12 to hold the overcap assembly in its opened position as shown in FIG. 1.

A sealing member 29 is securely attached to the inner surface 22 of the hingedly moveable portion 24 directly above the dispensing aperture 13. This sealing member is preferably made of a soft, resiliently deformable, sponge-like material such as closed-cell polyethylene available from Voltek Engineering, Lawrence, Massachusetts, and need be only slightly larger than the dispensing aperture 13. When the overcap assembly 20 is in its closed position (FIG. 2), the resultant gap between the inner surface 22 of the closure member 21 and the integral top lid 10 is smaller than the thickness of the sealing member 29. Consequently, the sealing member 29 is compressed against the integral top lid and forms a continuous tight seal around the periphery of the dispensing aperture 13. This tight seal allows the opened container to be reclosed and shaken without spilling the contaner's contents. If desired, the seal may be enhanced by applying finger pressure to the outer surface 23 of the closure member 21 in the area directly above the dispensing aperture 13.

Figure 3:
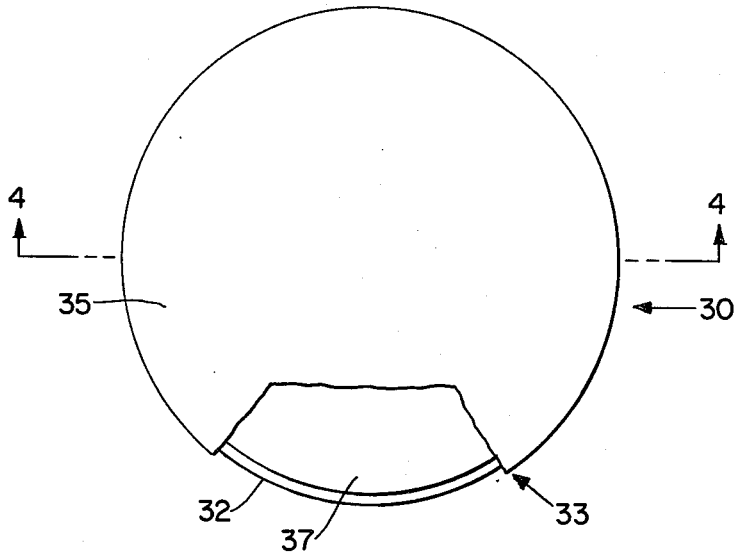
FIG. 3 is a partially segmented plan view of an alternative embodiment of the present invention, said embodiment having a sealing member that completely covers the container's top integral lid and being fully removable from a rimless container.
Figure 4:
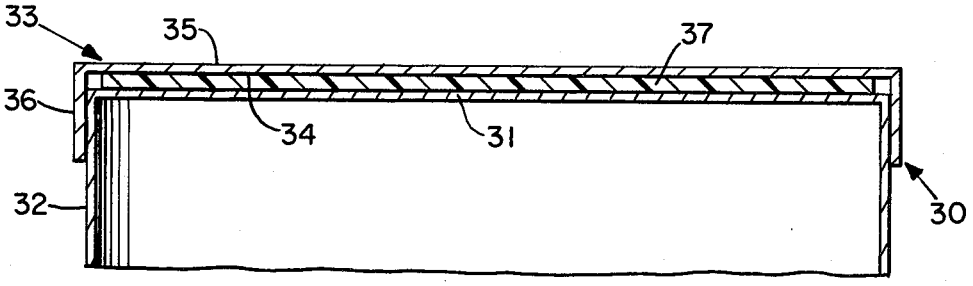
FIG. 4 is an enlarged cross-sectional view taken on section line 4—4 of FIG. 3.

FIG. 3 illustrates an independent overcap assembly generally referred to as 30. As shown in the enlarged cross-sectional view of FIG. 4, taken along section line 4—4 of FIG. 3, the overcap assembly 30 is removably attached to the top of a cylindrical container having an integral top lid 31 and side wall 32 and comprises a closure member 33 having an inner surface 34, an outer surface 35, and a downwardly projecting flange 36 running around the edge of closure member 33. The downwardly projecting flange 36 releasably engages the side wall 32 via an interference fit when the overcap assembly is applied to the container. A resiliently deformable sealing member 37, which is slightly smaller in diameter than the integral top lid 31, is attached to the inner surface 34 of the closure member 33. When the overcap assembly is applied to the container, the resultant gap between the inner surface 34 of the closure member 33 and the integral top lid 31 is smaller than the thickness of the sealing member 37. Consequently, the sealing member 37 is compressed against the integral top lid 31 and forms a tight seal around the periphery of any dispensing aperture (not shown) made in the top lid 31. The location of the dispensing aperture is not critical since the sealing member 37 completely covers the top lid 31.

Figure 5:
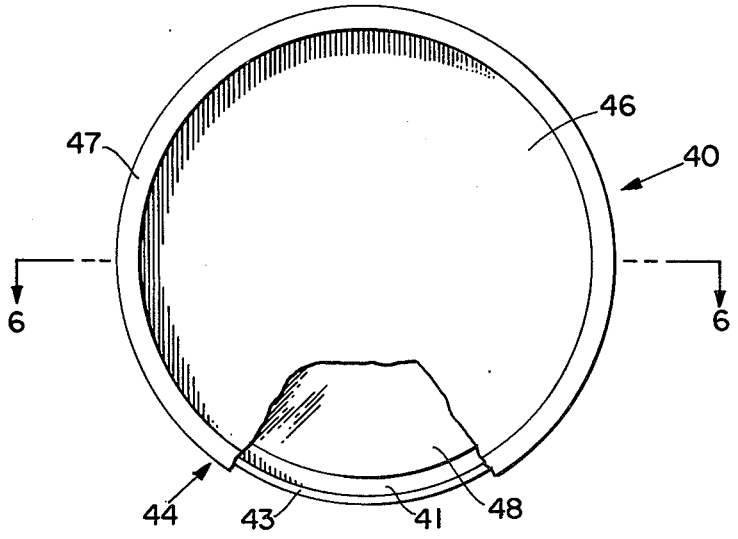
FIG. 5 is a partially segmented plan view of an alternative embodiment of the present invention, said embodiment having a sealing member that completely covers the container's top lid and being fully removable from a container having an upwardly projecting outer rim.
Figure 6:
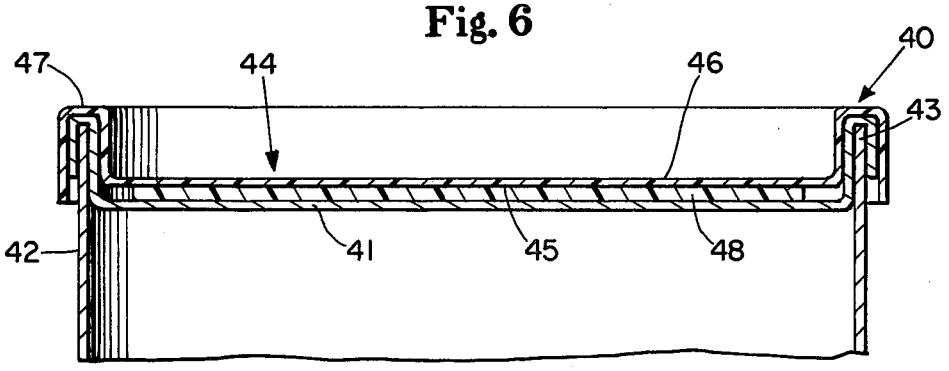
FIG. 6 is an enlarged cross-sectional view taken on section line 6—6 of FIG. 5.

FIG. 5 illustrates another independent overcap assembly generally referred to as 40. The overcap assembly is removably attached to the top of a cylindrical container having an integral top lid 41, a side wall 42, and an upwardly projecting outer rim 43. As shown in the enlarged cross-sectional view of FIG. 6, taken along section line 6—6 of FIG. 5, the overcap assembly 40 comprises a closure member 44 having an inner surface 45, an outer surface 46, and a U-shaped raised outer flange 47 running around the outer edge of closure member 44. The U-shaped outer flange releasably engages the upwardly projecting outer rim 43 of the container when the overcap is applied to the container. A resiliently-deformable sealing member 48, which is slightly smaller than the integral top lid 41, is securely attached to the inner surface 45 of the closure member 44. When the overcap assembly is applied to the container, the closure member 44 forces the sealing member 48 against the integral top lid 41 and forms a tight seal around the periphery of any dispensing aperture (not shown) made in the top lid 41. Since the sealing member completely covers the integral top lid 41, the exact location of the dispensing aperture is not critical. Accordingly, this type of overcap assembly is particularly suited for containers that do not have a pre-cut dispensing aperture, i.e., containers that are opened with a conventional punching device.

Figure 7:
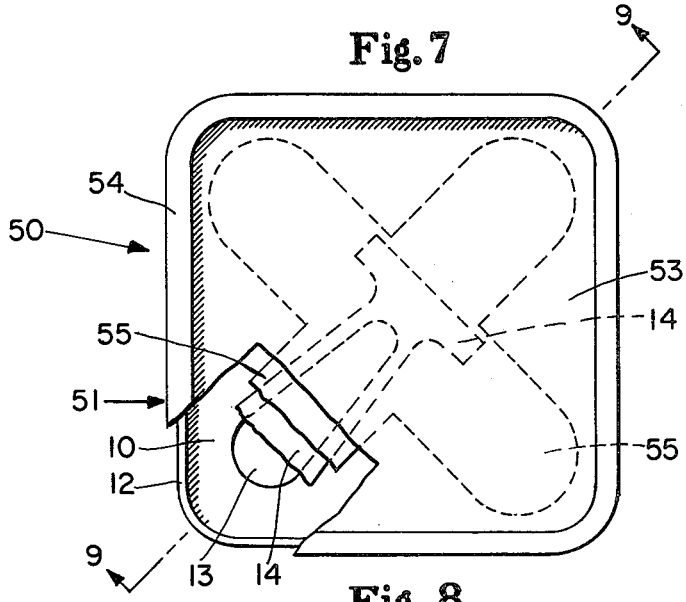
FIG. 7 is a partially segmented plan view of an alternative embodiment of the present invention, said embodiment having an X-shaped sealing member and being fully removable from a container having an upwardly projecting outer rim.
Figure 8:
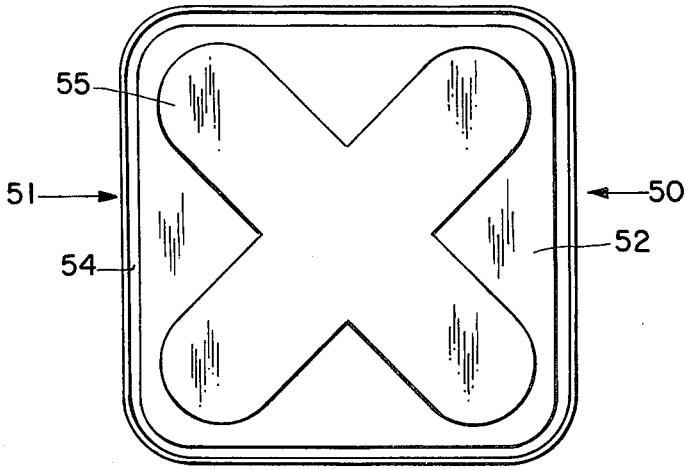
FIG. 8 is a bottom view of the alternative embodiment illustrated in FIG. 7.
Figure 9:
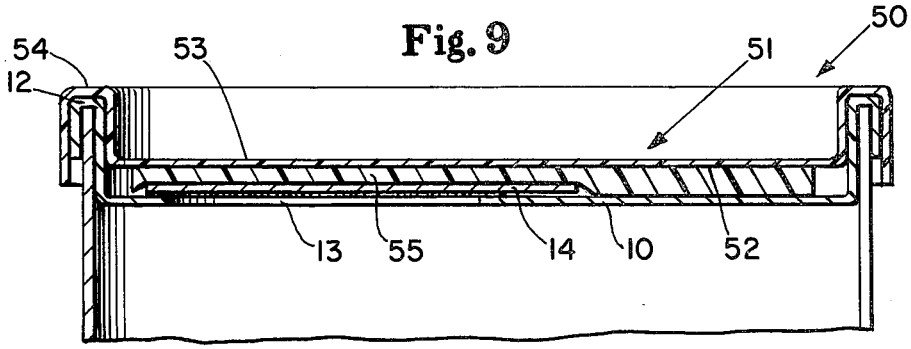
FIG. 9 is an enlarged cross-sectional view taken on section line 9—9 of FIG. 7.

FIG. 7 illustrates still another embodiment of the present invention removably attached to a rectangular container and generally referred to as 50. As shown in the enlarged cross-sectional view of FIG. 9 taken along section line 9—9 of FIG. 7, the overcap assembly 50 comprises a closure member 51 having an inner surface 52, an outer surface 53, and a U-shaped raised outer flange 54 running around the outer edge of closure member 51. The outer flange 54 releasably engages the upwardly projecting rim 12 of the container when the overcap is applied to the container. A resiliently deformable X-shaped sealing member 55 is attached to the inner surface 52 of the closure member 51. This type of overcap is particularly useful on a container having a pre-cut dispensing aperture 13 that is initially sealed with an adhesive tape tab 14 in one of the corners of the integral top lid 10. The X-shape of the sealing member 55 ensures that the overcap assembly will reseal the container's dispensing aperture 13 regardless of the overcap assemblie's orientation when applied to the container. Additionally, the X-shaped sealing member 55 has only small surface contact with the integral top lid 10 in the area of aperture 13 and consequently even light finger pressure applied to the outer surface 53 of closure member 51 will significantly enhance the seal formed between the dispensing aperture and the X-shaped sealing member 56.

A slight variation of the embodiment shown in FIG. 7 would have a sealing member only slightly larger than the dispensing aperture 13 securely attached to the inner surface 52 of the closure member 51. Of course this sealing member would be cheaper than the X-shaped sealing member but the overcap assembly could be accidentally re-applied to the container in such a way that the sealing member would not coincide with the location of the pre-cut aperture 13. Possible solutions to this problem would include making the closure member out of visually transparent material, or printing visual indicia on the outer surface 53 of the closure member 51 and side wall 11 such as a color coding with the printed words "align colored bars before shaking" or the like.

Figure 10:
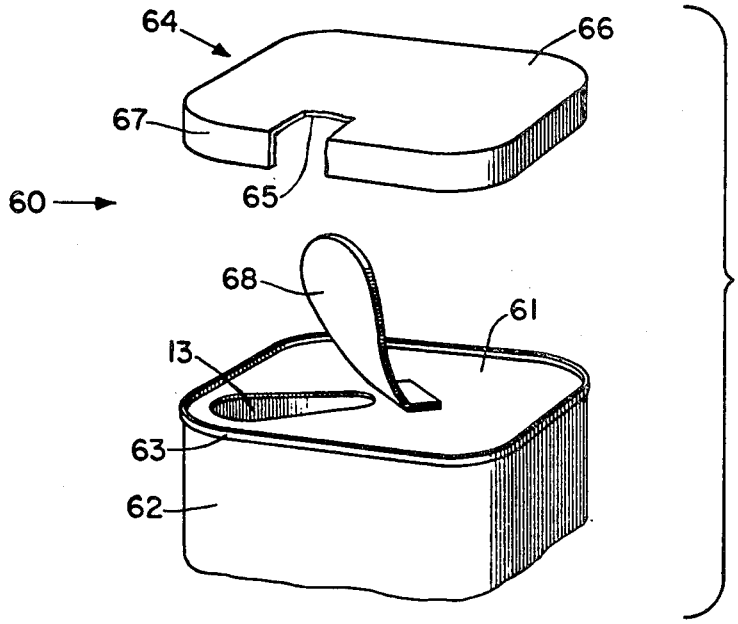
FIG. 10 is an exploded, partially segmented perspective view of an alternative embodiment of the present invention, said embodiment being fully removable from a container and having a sealing member hingedly attached to the container's integral top lid adjacent to the dispensing aperture.

FIG. 10 illustrates yet another embodiment of the present invention generally referred to as 60. In FIG. 10, the sealing member 68 is hingedly attached to the container's integral top lid 61 in close proximity to the pre-cut aperture 13 (shown in the open position). Alternatively, this feature could be obtained by attaching sealing member 68 to the inner surface of a small piece of tape and hingedly attaching one end of the tape to the integral top lid 61. When the closure member 64 is re-applied to the container, the inner surface 65 forces the sealing member 68 firmly against the dispensing aperture 13 thus forming a tight seal. The closure member 64 is held tightly on the container by way of an interference fit between the downwardly projecting flange 67 and the side wall 62 of the container.

Figure 11:
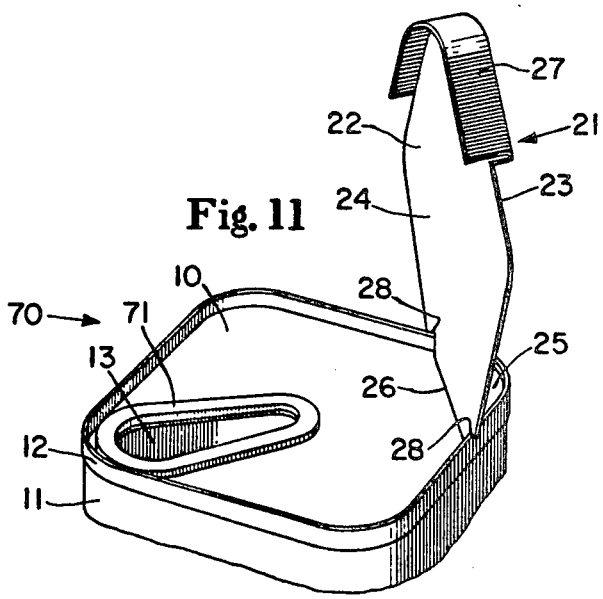
FIG. 11 is a perspective view of an alternative embodiment of the present invention, said embodiment being hingedly attached to the top integral lid of a container and having a sealing member attached to the contaner's integral top lid in the form of a thin strip that follows the outer contour of the dispensing aperture.

FIG. 11 illustrates another embodiment of the present invention generally referred to as 70. The embodiment is the same as the embodiment shown in FIG. 1 except that the sealing member 71 is attached to the integral top lid 10 rather than the inner surface 22 of the closure member 21. The sealing member 71 is a thin strip that follows the contour of the dispensing aperture 13. When the overcap assembly is in its closed position, the interference fit between the U-shaped raised outer flange 27 and the upstanding outer rim 12 of the container tightly holds the inner surface 22 of the closure member 21 against the sealing member 71 thus forming a seal. If desired, the seal may be enhanced by applying finger pressure to the outer surface 23 of the closure member 21 in the area directly above the dispensing aperture 13.

From the proceding descriptions, it will be apparent to those skilled in the art that many different configurations and variations of the present invention may be practiced to achieve the present invention's objectives. Accordingly, the following claims are intended to embrace all such configurations and variations that fall within the spirit and broad scope of the present invention.

What is claimed is:

1. An overcap assembly for resealing a container having an integral top lid and a side wall, said integral top lid having at least one discrete aperture for dispensing the container's contents after initial opening of said container, said overcap assembly comprising:

(a) a discrete closure member having an inner surface substantially coextensive with and facing said integral top lid and an outer surface facing away from said integral top lid when said overcap assembly is releasably secured to said container;

(b) a resiliently deformable sealing member for forming a continuous seal about the periphery of said discrete dispensing aperture when said overcap assembly is releasably secured to said container, said sealing member being secured to said inner surface of said closure member; and (c) means for releasably securing said overcap assembly to said container.

2. The overcap assembly as recited in claim 1 where said discrete closure member has a downwardly projecting flange at its outer edge and wherein said releasable securement means comprises an interference fit between said downwardly projecting outer flange of said closure member and said side wall of said container.

3. The overcap assembly as recited in claim 2 wherein said resiliently deformable sealing member is slightly larger than said discrete dispensing aperture in said integral top lid and is attached to said inner surface of said closure member in the area directly above said dispensing aperture when said overcap assembly is releasably secured to said container, said overcap assembly further including means for ensuring that said sealing member coincides with the location of said dispensing aperture when said closure member is releasably secured to said container.

4. The overcap assembly as recited in claim 3 wherein said means for ensuring that said member coincides with the location of said discrete dispensing aperture is said closure member being visually transparent.

5. The overcap assembly as recited in claim 3 wherein said means for ensuring that said sealing member coincides with the location of said dispensing aperture comprises visible indicia on the outer surface of said closure member and on said side wall of said container.

6. An overcap assembly for resealing a container having an integral top lid and a side wall, said integral top lid having at least one discrete aperture for dispensing the container's contents after initial opening of said container, said overcap assembly comprising:

(a) a closure member having an inner surface substantially coextensive with the facing said integral top lid and an outer surface facing away from said integral top lid when said overcap assembly is applied to said container, said closure member having a fixed portion and a movable portion, said portions being separated by hinging means, said fixed portion being attached to said integral top lid of said container;

(b) a resiliently deformable sealing member for forming a continuous seal about the periphery of said discrete dispensing aperture when said overcap assembly is applied to said contaner, said sealing member being secured to said surface of said movable portion of said closure member in the area directly above said dispensing aperture; and (c) means for releasably securing said movable portion of said closure member to said container.

7. The overcap assembly as recited in claim 6 where said movable portion of said closure member has a downwardly projecting flange at its outer edge and wherein said means for releasably securing said movable portion of said closure member to said container comprises an interference fit betwen said downwardly projecting outer flange and said side wall of said container.

8. The overcap assembly as recited in claim 6 wherein said hinging means comprises a score line in said closure member.

9. An overcap assembly for resealing a container having an integral top lid, a side wall, and an upwardly projecting outer rim running around the periphery of said integral top lid, said integral top lid having at least one discrete aperture for dispensing the container's contents after initial opening of said container, said overcap assembly comprising:

(a) a discrete closure member having an inner surface substantially coextensive with and facing said integral top lid and an outer surface facing away from said integral top lid when said overcap assembly is releasably secured to said container;

(b) a resiliently deformable sealing member for forming a continuous seal about the periphery of said discrete dispensing aperture when said overcap assembly is releasably secured to said container, said sealing member being secured to said inner surface of said closure member;

(c) means for releasably securing said overcap assembly to said container.

10. The overcap assembly as recited in claim 9 wherein said discrete closure member has a downwardly projecting U-shaped outer flange at its outer edge and wherein said releasable securement means comprises an interference fit between said downwardly projecting U-shaped outer flange and said upwardly projecting outer rim of said integral top lid.

11. The overcap assembly as recited in claim 9 wherein said resiliently deformable sealing member is slightly larger than said discrete dispensing aperture in said integral top lid and is attached to said inner surface of said closure member in the area directly above said dispensing aperture when said overcap assembly is releasably secured to said container, said overcap further including means for ensuring that said sealing member coincides with the location of said dispensing aperture when said closure member is releasably secured to said container.

12. The overcap assembly as recited in claim 11 wherein said means for ensuring that said sealing member coincides with the location of said discrete dispensing aperture is said closure member having visually transparent.

13. The overcap assembly as recited in claim 11, wherein said means for ensuring that said sealing member coincides with the location of said dispensing aperture comprises visible indicia on the outer surface of said closure member and on said side wall of said container.

14. An overcap assembly for resealing a container having an integral top lid, a side wall, and an upwardly projecting outer rim running around the periphery of said integral top lid, said integral top lid having at least one discrete aperture for dispensing the container's contents after initial opening of said container, said overcap assembly comprising:

(a) a closure member having an inner surface substantially coextensive with and facing said integral top lid and an outer surface facing away from said integral top lid when said overcap assembly is applied to said container, said closure member having a fixed portion and movable portion, said portions being separated by hinging means, said fixed portion being attached to said integral top lid of said container;

(b) a resiliently deformable sealing member for forming a continuous seal about the periphery of said discrete dispensing aperture when said overcap assembly is applied to said container, said sealing member being secured to said inner surface of said movable portion of said closure member in the area directly above said dispensing aperture; and (c) means for releasably securing said movable portion of said closure member to said container.

15. The overcap assembly as recited in claim 14 wherein said movable portion of said closure member has a downwardly projecting U-shaped outer flange at its outer edge and wherein said means for releasably securing said movable portion of said closure member to said container comprises an interference fit between said downwardly projecting U-shaped outer flange of said closure member and said upwardly projecting outer rim of said integral top lid.

16. The overcap assembly as recited in claim 14 wherein said hinging means comprises a score line in said closure member.

17. A container that may be resealed after initial opening to allow said container to be shaken without spilling the contents of said container, said container comprising:

(a) a continuous side wall;

(b) an integral top lid and an integral bottom lid, said lids being continuously sealed to the respective opposing ends of said continuous side wall of said container, said integral top lid having at least one discrete aperture for dispensing said contents of said container after opening of said container;

(c) a resiliently deformable sealing member for forming a continuous seal about the periphery of said discrete dispensing aperture, said sealing member having a fixed portion and a movable portion, said fixed portion being attached to said integral top lid of said container adjacent to said dispensing aperture, said movable portion being manually held away from said discrete dispensing aperture when the contents of said container are dispensed;

(d) a closure member having an inner surface substantially coextensive with and facing said integral top lid and an outer surface facing away from said integral top lid when said closure member is applied to said container;

(e) means for releasably securing said closure member to said container.

18. The container as recited in claim 17 wherein said closure member has a downwardly projecting flange at its outer edge and wherein said releasable securement means comprises an interference fit between sid downwardly projecting outer flange of said closure member and said continuous side wall of said container.

19. A container that may be resealed after initial opening to allow said container to be shaken without spilling the contents of said container, said container comprising:

(a) a continuous side wall;

(b) an integral top lid and an integral bottom lid, said lids being continuously sealed to the respective opposing ends of said continuous side wall of said container, said integral top lid having at least one discrete aperture for dispensing said contents of said container after initial opening of said container;

(c) a resiliently deformable sealing member for forming a continuous seal about the periphery of said discrete dispensing aperture, said sealing member having a fixed portion and a movable portion, said fixed portion being attached to said integral top lid of said container adjacent to said dispensing aperture, said movable portion being manually held away from said discrete dispensing aperture when the contents of said container are dispensed;

(d) a closure member having a inner surface substantially coextensive with and facing said integral top lid and an outer surface facing away from said integral top lid when said closure member is applied to said container, said closure member having a fixed portion and a movable portion, said portions being separated by hinging means, said fixed portion being attached to said integral top lid of said container;

(e) means for releasably securing said movable portion of said closure member to said container.

20. The container as recited in claim 19 wherein said movable portion of said closure member has a downwardly projecting flange at its outer edge and wherein said means for releasably securing said movable portion of said closure member to said container comprises an interference fit between said downwardly projecting outer flange of said closure member and said continuous side wall of said container.

21. The container as recited in claim 19 wherein said hinging means comprises a score line in said closure member.

22. A container that may be resealed after initial opening to allow said container to be shaken without spilling the contents of said container, said container comprising:

(a) a continuous side wall;

(b) an integral top lid and an integral bottom lid, said lids being continuously sealed to the respective opposing ends of said continuous side wall of said container, said integral top lid having at least one discrete aperture for dispensing said contents of said container after initial opening of said container;

(c) a resiliently deformable sealing member for forming a continuous seal about the periphery of said discrete dispensing aperture, said sealing member being a thin strip that encircles said discrete dispensing aperture and that is attached to said integral top lid;

(d) a closure member having an inner surface substantially coextensive with and facing said integral top lid and an outer surface facing away from said integral top lid when said closure member is applied to said container;

(e) means for releasably securing said closure member to said container.

23. The container as recited in claim 22 wherein said closure member has a downwardly projecting flange at its outer edge and wherein said releasable securement means comprises an interference fit between said downwardly projecting outer flange of said closure member and said continuous side wall of said container.

24. A container that may be resealed after initial opening to allow said container to be shaken without spilling the contents of said container, said container comprising:

(a) a continuous side wall;

(b) an integral top lid and an integral bottom lid, said lids being continuously sealed to the respective opposing ends of said continuous side wall of said container, said integral top lid having at least one discrete aperture for dispensing said contents of said container after initial opening of said container;

(c) a resiliently deformable sealing member for forming a continuous seal about the periphery of said discrete dispensing aperture, said sealing member being a thin strip that encircles said discrete dispensing aperture and that is attached to said integral top lid;

(d) a closure member having an inner surface substantially coextensive with and facing said integral top lid and an outer surface facing away from said integral top lid when said closure member is applied to said container, said closure member having a fixed portion and a movable portion, said portions being separated by hinging means, said fixed portion being attached to said integral top lid of said container;

(e) means for releasably securing said movable portion of said closure member to said container.

25. The container as recited in claim 24 wherein said movable portion of said closure member has a downwardly projecting flange at its outer edge and wherein said means for releasably securing said movable portion of said closure member to said container comprises an interference fit between said downwardly projecting outer flange of said closure member and said continuous side wall of said container.

26. The container as recited in claim 24 wherein said hinging means comprises a score line in said closure member.

* * * * *

UNITED STATES PATENT AND TRADEMARK OFFICE

CERTIFICATE OF CORRECTION

PATENT NO. : 4,473,168

DATED : September 25, 1984

INVENTOR(S) : WILLIAM A. COX

It is certified that error appears in the above-identified patent and that said Letters Patent is hereby corrected as shown below:

Column 2, line 14, "a" should read -- an --.

Column 3, line 7, "tap" should read -- tab --.

Column 3, line 8, after "also" insert -- well --.

Column 4, line 52, "assemblie's" should read -- assembly's --.

Column 5, line 36, "proceding" should read -- preceding --.

Column 6, line 13, after "ensuring that said" insert -- sealing --.

Column 6, line 27, "the" should read -- and --.

Column 6, line 39, after "secured to said" insert -- inner --.

Column 6, line 49, "betwen" should read -- between --.

Column 7, line 28, "having" should read -- being --.

Column 8, line 36, "sid" should read -- said --.

Column 8, line 60, "a", second occurrence, should read -- an --.

Signed and Sealed this

*Twenty-sixth* Day of *February 1985*

[SEAL]

*Attest:*

DONALD J. QUIGG

*Attesting Officer* *Acting Commissioner of Patents and Trademarks*